US011359255B2

(12) United States Patent
Kariya et al.

(10) Patent No.: US 11,359,255 B2
(45) Date of Patent: Jun. 14, 2022

(54) STEEL SHEET FOR CROWN CAP, CROWN CAP AND METHOD FOR PRODUCING STEEL SHEET FOR CROWN CAP

(71) Applicant: JFE STEEL CORPORATION, Tokyo (JP)

(72) Inventors: Nobusuke Kariya, Tokyo (JP); Takashi Ueno, Tokyo (JP); Yoshihide Yamamoto, Tokyo (JP); Katsumi Kojima, Tokyo (JP); Bungo Tateno, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 376 days.

(21) Appl. No.: 16/628,793

(22) PCT Filed: Jul. 25, 2018

(86) PCT No.: PCT/JP2018/027995
§ 371 (c)(1),
(2) Date: Jan. 6, 2020

(87) PCT Pub. No.: WO2019/026739
PCT Pub. Date: Feb. 7, 2019

(65) Prior Publication Data

US 2020/0199706 A1 Jun. 25, 2020

(30) Foreign Application Priority Data

Jul. 31, 2017 (JP) ..... JP2017-148315

(51) Int. Cl.

| | |
|---|---|
| ***C21D 9/46*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 8/02*** | (2006.01) |
| ***C21D 6/00*** | (2006.01) |
| ***B65D 41/12*** | (2006.01) |

(52) U.S. Cl.
CPC ..... *C21D 9/46* (2013.01); *B65D 41/12* (2013.01); *C21D 6/005* (2013.01); *C21D 6/008* (2013.01); *C21D 8/0205* (2013.01); *C21D 8/0226* (2013.01); *C21D 8/0247* (2013.01); *C22C 38/001* (2013.01); *C22C 38/002* (2013.01); *C22C 38/02* (2013.01); *C22C 38/04* (2013.01); *C22C 38/06* (2013.01); *C21D 2211/005* (2013.01)

(58) Field of Classification Search
None
See application file for complete search history.

(56) References Cited

U.S. PATENT DOCUMENTS

| | | | |
|---|---|---|---|
| 9,657,382 | B2 | 5/2017 | Funakawa et al. |
| 2016/0362761 | A1 | 12/2016 | Hiraguchi et al. |

FOREIGN PATENT DOCUMENTS

| | | | |
|---|---|---|---|
| JP | 2000248335 | A | 9/2000 |
| JP | 2013133497 | A | 7/2013 |
| JP | 2015137422 | A | 7/2015 |
| JP | 2015199987 | A | 11/2015 |
| JP | 6057023 | B2 | 1/2017 |
| WO | 2015129191 | A1 | 9/2015 |

OTHER PUBLICATIONS

Sep. 18, 2018, International Search Report issued in the International Patent Application No. PCT/JP2018/027995.

*Primary Examiner* — Anthony M Liang
(74) *Attorney, Agent, or Firm* — Kenja IP Law PC

(57) ABSTRACT

A steel sheet for crown cap having: a chemical composition containing, C, Si, Mn, P, S, Al, N, with the balance being Fe and inevitable impurities; a ferrite phase in a region from a depth of ¼ of a sheet thickness to a mid-thickness part, the ferrite phase having a standard deviation of ferrite grain size of 7.0 μm or less; a yield strength of 560 MPa or more and 700 MPa or less in a rolling direction; and a difference of 25 MPa or more between a yield strength in a 2% strain tensile test and a yield strength in a tensile test after heat treatment at 170° C. for 20 minutes, in the rolling direction.

7 Claims, No Drawings

STEEL SHEET FOR CROWN CAP, CROWN CAP AND METHOD FOR PRODUCING STEEL SHEET FOR CROWN CAP

TECHNICAL FIELD

This disclosure relates to a steel sheet for crown cap, in particular, a steel sheet for crown cap which has excellent formability and from which a crown cap having pressure resistance enough for beverages containing a high carbon dioxide content can be produced.

Further, this disclosure relates to a crown cap made of the steel sheet for crown cap and a method for producing the steel sheet for crown cap.

BACKGROUND

Glass bottles are generally used as containers for beverages such as soft drinks and alcoholic drinks. A metal cap referred to as a crown cap is widely used for, in particular, a narrow-mouthed glass bottle. Crown caps are typically produced by press forming, using a thin steel sheet as a material. A crown cap includes a disk-shaped portion which covers the mouth of a bottle and a pleated portion disposed in the periphery thereof, and by crimping the pleated portion around the mouth of a bottle, the bottle is hermetically sealed.

A bottle provided with a crown cap is often filled with contents that cause high internal pressure, such as beer or carbonated beverages. Therefore, the crown cap is required to have a pressure resistance so that, even when the internal pressure is increased because of a change in temperature or the like, the sealing of the bottle is not broken by deformation of the crown cap. Carbonated beverages typically have a higher carbon dioxide content (GV) than beer. Thus, when a crown cap is used for a carbonated beverage, the crown cap is required to have an especially high pressure resistance.

When carbonated beverages having a high GV are stored in a warehouse in which the temperature becomes higher than the ordinary temperature, the internal pressure may be as extremely high as 180 psi (1.241 MPa) or more, causing the deformation of crown caps and subsequent leakage of contents. Therefore, to prevent the leakage of contents, a resin liner is mainly attached as a seal material to a crown cap to improve the adhesion between the crown cap and a bottle mouth. In particular, for a crown cap used for a carbonated beverage having a high GV, a soft liner is used to improve the pressure resistance of the crown cap.

However, the improvement of the pressure resistance by using a soft liner is limited. Thus, when the internal pressure becomes as high as 180 psi (1.241 MPa) or more, to prevent the deformation of a crown cap, a high-strength steel sheet needs to be used as a material for producing the crown cap. Further, when a material having a sufficient strength is used but a thin steel sheet having low material homogeneity is used for crown caps, crown caps which are different in shapes and thus fail to meet the product standards would be produced. When a crown cap has a defective shape, sufficient sealability may not be obtained, and thus, a material steel sheet is also required to have excellent material homogeneity.

A single reduced (SR) steel sheet is mainly used as a thin steel sheet that serves as a material of a crown cap. Such a SR steel sheet is produced by reducing the thickness of a steel sheet by cold rolling, and subsequently subjecting the steel sheet to annealing and temper rolling. A conventional steel sheet for crown cap generally has a sheet thickness of 0.22 mm or more and a sufficient pressure resistance and the formability have been capable of being ensured by the use of a SR material made of mild steel used for, for example, cans for foods or beverages.

In recent years, however, a sheet metal thinning has been increasingly required for a steel sheet for crown cap, as well as a steel sheet for can, for the purpose of cost reduction of crown caps. When the thickness of a steel sheet for crown cap is less than 0.22, in particular, 0.20 mm or less, a crown cap produced from a conventional SR material is short of pressure resistance. To ensure the pressure resistance, a reduction in strength due to the sheet metal thinning needs to be compensated and thus a double-reduced (DR) steel sheet obtained by performing annealing and subsequent secondary cold rolling for work hardening has been used.

When a crown cap is produced from a steel sheet for crown cap, a central portion is drawn to a certain degree in the initial stage of forming and subsequently, an outer edge portion is formed into a pleated shape. When the crown cap material is a steel sheet having low material homogeneity, crown caps having different outer diameters and heights would be produced and fail to meet the product standards. When crown caps having different outer diameters and heights are produced and fail to meet the product standards, a problem such as the decrease in a yield is caused when a large amount of crown caps are produced. Further, a crown cap failing to meet the standards in its outer diameter and height easily causes leakage of contents during transportation after the crown cap has been driven to a bottle, and thus such a crown cap does not play a role as a lid. Even if a crown cap meets the product standards in its outer diameter and height, when a steel sheet as a material of the crown cap has low strength, the crown cap may be detached due to the lack in pressure resistance even when the crown cap is attached with a soft liner having a role of improving the pressure resistance.

In light of the above, for example, JP 6057023 B (PTL 1) proposes a steel sheet for crown cap having a chemical composition containing, in mass %, C: 0.0010% to 0.0060%, Si: 0.005% to 0.050%, Mn: 0.10% to 0.50%, Ti: 0% to 0.100%, Nb: 0% to 0.080%, B: 0% to 0.0080%, P: 0.040% or less, S: 0.040% or less, Al: 0.1000% or less, N: 0.0100% or less, with a balance being Fe and inevitable impurities. The steel sheet for crown cap further has a minimum r value of 1.80 or more in a direction of 25° to 65° with respect to the rolling direction of the steel sheet, a mean r value of 1.70 or more in a direction of 0° or more and less than 360° with respect to the rolling direction, and a yield strength of 570 MPa or more.

CITATION LIST

Patent Literature

PTL 1: JP 6057023 B

SUMMARY (Technical Problem)

For the steel sheet of PTL 1, a r value in a predetermined direction is made suitable for production of crown caps by using steel containing C of 0.0060% or less and making the tension between stands in secondary cold rolling and the annealing temperature have a predetermined relationship. However, because a hot rolling process which affects the metallic structure formation is not controlled, a steel sheet obtained by the method of PTL 1 has an increased variation in material properties, and thus it is difficult to provide such a steel sheet for practical use for beverages having a high carbon dioxide content.

It could thus be helpful to provide a steel sheet for crown cap which has excellent formability and from which a crown cap having a sufficient pressure resistance applicable to beverages having a high carbon dioxide content can be produced with the use of a soft liner even when the steel sheet is subjected to sheet metal thinning.

Further, it could also be helpful to provide a crown cap produced using the steel sheet for crown cap and a method for producing the steel sheet for crown cap.

(Solution to Problem)

Primary features of this disclosure are as follows.

1. A steel sheet for crown cap having a chemical composition containing (consisting of), in mass %, C: more than 0.0060% and 0.0100% or less, Si: 0.05% or less, Mn: 0.05% or more and 0.60% or less, P: 0.050% or less, S: 0.050% or less, Al: 0.020% or more and 0.050% or less, and N: 0.0070% or more and 0.0140% or less, with the balance being Fe and inevitable impurities, wherein the steel sheet has a ferrite phase in a region from a depth of ¼ of a sheet thickness to a mid-thickness part, the ferrite phase having a standard deviation of ferrite grain size of 7.0 μm or less, the steel sheet has a yield strength of 560 MPa or more and 700 MPa or less in a rolling direction, and the steel sheet has a difference of 25 MPa or more between a yield strength in a 2% strain tensile test and a yield strength in a tensile test after heat treatment at 170° C. for 20 minutes, in the rolling direction.

2. The steel sheet for crown cap according to 1. having a sheet thickness of 0.20 mm or less.

3. A crown cap obtained by forming the steel sheet for crown cap according to 1. or 2.

4. The crown cap according to 3. comprising a resin liner having an ultra-low loaded hardness of less than 0.70.

5. A method for producing the steel sheet for crown cap according to 1. or 2. comprising:

hot rolling a steel slab having the chemical composition according to 1., whereby the steel slab is heated to a slab heating temperature of 1200° C. or higher, and then the steel slab is subjected to hot rolling under conditions of a finisher delivery temperature of 870° C. or higher and a rolling reduction at a final stand of 10% or more to obtain a steel sheet, and then the steel sheet is coiled at a coiling temperature of 550° C. to 750° C.;

after the hot rolling, pickling the steel sheet;

after the pickling, subjecting the steel sheet to primary cold rolling at a rolling reduction of 88% or more;

after the primary cold rolling, subjecting the steel sheet to continuous annealing; and after the continuous annealing, subjecting the steel sheet to secondary cold rolling at a rolling reduction of 10% to 40%, wherein in the continuous annealing, the steel sheet is heated to a soaking temperature of 660° C. to 760° C. at an average heating rate of 15° C./s or less in a temperature range from 600° C. to the soaking temperature, the steel sheet is then held in a temperature range of 660° C. to 760° C. for a holding time of 60 seconds or less, after the holding, the steel sheet is subjected to primary cooling to a temperature of 450° C. or lower at an average cooling rate of 10° C./s or more, and subsequently, the steel sheet is subjected to secondary cooling to a temperature of 140° C. or lower at an average cooling rate of 5° C./s or more.

(Advantageous Effect)

According to this disclosure, it is possible to provide a steel sheet for crown cap which has excellent formability and from which a crown cap having a sufficient pressure resistance applicable to beverages having a high carbon dioxide content can be produced with the use of a soft liner even when the steel sheet is subjected to sheet metal thinning.

DETAILED DESCRIPTION

Next, detailed description is given below.

[Chemical Composition]

It is important that a steel sheet for crown cap according to one of the disclosed embodiments has the chemical composition stated above. The reasons for limiting the chemical composition of the steel sheet for crown cap according to this disclosure as stated above are described first. In the following description of each chemical component, the unit "%" is "mass %" unless otherwise specified.

C: More than 0.0060% and 0.0100% or Less

A C content of 0.0060% or less coarsens ferrite of a steel sheet after subjection to the following secondary cold rolling, thus deteriorating the formability. From such a steel sheet, crown caps having non-uniform outer diameters and heights would be formed. Further, when the C content is 0.0060% or less, the yield strength difference between 2% strain tension and re-tension in a rolling direction is less than 25 MPa, and a high pressure resistance cannot be obtained even if a soft liner is used in combination. On the other hand, the C content beyond 0.0100% makes ferrite of a steel sheet after subjection to the secondary cold rolling extremely fine, and thus the steel sheet strength is extremely increased, deteriorating the formability. From such a steel sheet, crown caps having non-uniform outer diameters and height would be formed. Accordingly, the C content is set to more than 0.0060% and 0.0100% or less. The C content is preferably set to 0.0065% or more and 0.0090% or less.

Si: 0.05% or Less

An extremely high Si content deteriorates the uniformity of the outer diameters and heights of crown caps for the same reason as C. Accordingly, the Si content is set to 0.05% or less. Excessively reducing the Si content leads to increased steelmaking costs. Thus, the Si content is preferably set to 0.004% or more.

Mn: 0.05% or More and 0.60% or Less

When the Mn content is less than 0.05%, it is difficult to avoid the hot shortness even if the S content is decreased, causing a problem such as surface cracking during continuous casting. Accordingly, the Mn content is set to 0.05% or more. On the other hand, an extremely high Mn content deteriorates the uniformity of the outer diameters and heights of crown caps for the same reason as C. Accordingly, the Mn content is set to 0.60% or less. The Mn content is preferably set to 0.10% or more and 0.50% or less.

P: 0.050% or Less

When the P content is beyond 0.050%, the steel sheet is hardened and the corrosion resistance is lowered. Further, the standard deviation of ferrite grain size after annealing becomes beyond 7.0 μm, and the heights of crown caps become non-uniform. Accordingly, the upper limit of the P content is set to 0.050%. Further, reducing the P content to less than 0.001% excessively increases dephosphorization costs, and thus, the P content is preferably set to 0.001% or more.

S: 0.050% or Less

S binds to Mn in a steel sheet to form MnS, and a large amount of MnS is precipitated, thus lowering the hot ductility of the steel sheet. A S content beyond 0.050% makes this effect significant. Accordingly, the S content is set to 0.050% or less. On the other hand, reducing the S content to less than 0.005% excessively increases desulfurization costs, and thus, the S content is preferably set to 0.005% or more.

Al: 0.020% or More and 0.050% or Less

Al is an element contained as a deoxidizer. Al forms AlN with N in steel to decrease solute N in the steel. When the Al content is less than 0.020%, the effect as a deoxidizer is insufficient, causing solidification defect and increasing steelmaking costs. Further, when the Al content is less than 0.020%, a suitable amount of AlN cannot be obtained during recrystallization of ferrite in annealing. Thus, the standard deviation of ferrite grain size after the annealing is increased and the ferrite grain size of a steel sheet after subjection to the secondary cold rolling is coarsened. From such a steel sheet, crown caps having non-uniform outer diameters and heights would be formed. Therefore, the Al content is set to 0.020% or more. The Al content is preferably set to 0.030% or more. On the other hand, an Al content beyond 0.050% increases the formation of AlN and, as stated below, decreases the N amount contributing as solute N to the steel sheet strength, lowering the steel sheet strength. Therefore, the Al content is set to 0.050% or less. The Al content is preferably 0.045% or less.

N: 0.0070% or More and 0.0140% or Less

A N content less than 0.0070% coarsens the ferrite grain size of a steel sheet after subjection to the secondary cold rolling. From such a steel sheet, crown caps having non-uniform outer diameters and heights would be formed and in the steel sheet, the N amount contributing as solute N to the steel sheet strength is decreased as stated below to lower the steel sheet strength. Further, the yield strength difference between 2% strain tension and re-tension in a rolling direction is less than 25 MPa, and a high pressure resistance cannot be obtained even if a soft liner is used in combination. On the other hand, a N content beyond 0.0140% makes the ferrite grain size of a steel sheet after subjection to the secondary cold rolling extremely fine. From such a steel sheet, crown caps having non-uniform outer diameters and height would be formed. Accordingly, the N content is set to 0.0070% or more and 0.0140% or less. The N content is preferably set to 0.0085% or more and 0.0125% or less, and more preferably more than 0.0100% and 0.0125% or less.

The chemical composition of a steel sheet for crown cap in one of the embodiments may consist of the elements stated above with the balance being Fe and inevitable impurities.

[Metallic Structure]

It is important that the metallic structure of a steel sheet for crown cap according to this disclosure has a ferrite phase in at least a region from a depth of ¼ of the sheet thickness to a mid-thickness part and the ferrite phase has a standard deviation of ferrite grain size of 7.0 μm or less.

To impart excellent formability to a steel sheet for crown cap, the steel sheet requires to have a metallic structure in which the region from a depth of ¼ of the sheet thickness to a mid-thickness part has a ferrite phase. The metallic structure in the region from a depth of ¼ of the sheet thickness to the mild-thickness part preferably mainly has a ferrite phase with the balance being cementite, the ferrite phase occupying 85 vol % or more. When the ferrite phase is 85 vol % or more, fractures originating from cementite generated during processing hardly occur and thus the steel sheet has more excellent formability.

However, even if the steel sheet has a ferrite phase in the region from a depth of ¼ of the sheet thickness to a mid-thickness part, when the region has a ferrite grain size distribution which standard deviation is more than 7.0 μm, the formability is deteriorated. As a result, crown caps having non-uniform outer diameters and heights and a lowered pressure resistance would be formed, and the yield in producing crown caps is lowered. Accordingly, the standard deviation of ferrite grain size in the region is set to 7.0 μm or less. The standard deviation is preferably set to 6.5 μm or less. On the other hand, the standard deviation is preferably smaller, and thus no lower limit is placed on the standard deviation. However, it is difficult to set the standard deviation to less than 5.0 μm due to variations in producing conditions or the like. Accordingly, the standard deviation is preferably set to 5.0 μm or more.

The metallic structure of a steel sheet for crown cap can be evaluated using a micrograph taken with an optical microscope. The specific procedures are as follows.

First, a cross section of a steel sheet for crown cap taken in the sheet thickness direction parallel to the rolling direction of the steel sheet is observed with an optical microscope over a region of from a depth position of ¼ of the sheet thickness (a position of ¼ in the sheet thickness direction from the surface in the cross section) to a position of ½ of the sheet thickness to obtain micrographs. Next, the obtained micrographs are used to specify ferrite by visual observation. Subsequently, the micrographs are subjected to image interpretation to determine ferrite grain sizes. In each field, a ferrite grain size distribution is determined to calculate its standard deviation. The average value of the standard deviations in 10 fields is defined as a standard deviation of ferrite grain size. More specifically, the method described in the subsequent EXAMPLES section can be used for evaluation.

The metallic structure can be obtained by using a steel slab having the chemical composition stated above as a material to produce a steel sheet for crown cap under the following conditions.

[Yield Strength Difference]

As mechanical properties of a steel sheet according to this disclosure, it is important that the steel sheet has a yield strength difference between a 2% strain tensile test and a tensile test after heat treatment (hereinafter, also referred to simply as "yield strength difference"), in a rolling direction of 25 MPa or more. That is, if the steel sheet has a yield strength difference of less than 25 MPa, when many crown caps are produced from the steel sheet and subjected to a pressure resistance test, some crown caps would be found to have a low pressure resistance, thus lowering the yield in producing crown caps. Accordingly, the yield strength difference is set to 25 MPa or more. The yield strength difference is preferably set to 30 MPa or more.

On the other hand, no upper limit is placed on the yield strength difference, but when the yield strength difference is extremely large, the steel sheet strength is extremely increased by heat treatment. When such a steel sheet is provided for crown caps, crown caps having non-uniform shapes may be formed. Further, when many crown caps are produced and subjected to a pressure resistance test, some crown caps would be found to have a low pressure resistance and the yield in producing crown caps may be lowered. Accordingly, the yield strength difference is preferably set to 50 MPa or less.

The yield strength difference can be measured by a method in accordance with a test method for a degree of paint bake hardening (BH degree) defined in "JIS G3135". First, a tensile test piece with a size of JIS No. 5 is collected from a steel sheet for crown cap in a direction parallel to the rolling direction of the steel sheet. Next, using the test piece, a tensile test is conducted in accordance with "JIS G3135" to measure a 2% pre-strain load. Specifically, 2% pre-strain is added to the test piece, a load at that time (2% pre-strain load: P1) is read, and subsequently the load is removed. Next, the test piece added with the pre-strain is subjected to heat treatment at 170° C. for 20 minutes, and after the heat treatment, a tensile test is conducted again to read a yield load (load after heat treatment: P2). A BH degree (MPa) can be calculated from P1, P2, and a cross-sectional area (A) of the parallel portion of the test piece before the pre-strain by the following formula (1). The obtained BH degree is defined as the yield strength difference between the 2% strain tensile test and the tensile test after heat treatment, in a rolling direction.

$$BH=(P2-P1)/A \quad (1)$$

The yield strength difference satisfying the conditions stated above can be obtained by using a steel slab having the chemical composition stated above as a material and producing a steel sheet for crown cap under the following conditions.

[Yield Strength]

For a steel sheet having the chemical composition and structure as stated above, a high strength, specifically, a yield strength of 560 MPa or more can be ensured. When a steel sheet for crown cap is used for a crown cap, the steel sheet is required to have a pressure resistance which prevents a crown cap crimped around the mouth of a bottle from being removed by internal pressure. Conventional steel sheets for crown cap have a sheet thickness of 0.22 mm or more, but when the thickness of a steel sheet for crown cap is reduced to 0.20 mm or less, in particular 0.18 mm or less by sheet metal thinning, the steel sheet for crown cap needs to have a higher strength than conventional steel sheets.

When a steel sheet has a yield strength of less than 560 MPa, a crown cap with a reduced thickness as stated above produced from the steel sheet cannot obtain a sufficient pressure resistance. Accordingly, the yield strength of the steel sheet for crown cap is set to 560 MPa or more. To ensure a higher pressure resistance, the yield strength is preferably set to 600 MPa or more. On the other hand, when the yield strength is extremely high, the heights of crown caps are reduced during crown cap forming and the shapes of the crown caps become non-uniform. Thus, the yield strength is set to 700 MPa or less. The yield strength is more preferably set to 680 MPa or less. The yield strength refers to the yield strength in the rolling direction of the steel sheet for crown cap. The yield strength can be measured by the method for tensile testing of metallic materials defined in "JIS Z 2241".

[Sheet Thickness]

The sheet thickness of the steel sheet for crown cap is not particularly limited and may have any thickness. However, from the viewpoint of cost reduction, the sheet thickness is preferably set to 0.20 mm or less, and more preferably 0.18 mm or less, and further preferably 0.17 mm or less. When the sheet thickness is below 0.14 mm, disadvantages in terms of producing costs are caused. Thus the lower limit of the sheet thickness is preferably set to 0.14 mm.

A steel sheet for crown cap of one of the embodiments can arbitrarily have at least one of a chemical conversion treatment layer, a coating or plating layer, or a coat or film on its one or both surfaces. As the coating or plating layer, any coating or plating film such as a tin coating or plating layer, a chromium coating or plating layer, and a nickel coating or plating layer can be used. Further, as the coat or film, a coat or film of, for example, a print coating, adhesive varnish, and the like can be used.

[Producing Method]

The following describes a method for producing a steel sheet for crown cap according to one of the embodiments. In the following description, a temperature is specified based on a surface temperature of a steel sheet. Further, an average heating rate and an average cooling rate are obtained based on a surface temperature of a steel sheet.

A steel sheet for crown cap according to one of the embodiments can be produced by subjecting a steel slab having the chemical composition as stated above to the following steps (1) to (5) in sequence:

(1) Hot rolling step
(2) Pickling step
(3) Primary cold rolling step
(4) Continuous annealing step
(5) Secondary cold rolling step.

[Steel Slab]

First, steel adjusted to the chemical composition as stated above is prepared by steelmaking using, for example, a converter to produce a steel slab. The method for producing the steel slab is not particularly limited, and the steel slab may be produced by any method such as continuous casting, ingot casting, and thin slab casting. However, the steel slab is preferably produced by continuous casting so as to prevent macro segregation of the components.

[Hot Rolling Step]

Next, the steel slab is subjected to a hot rolling step. In the hot rolling step, the steel slab is heated, the heated steel slab is subjected to hot rolling comprising rough rolling and finish rolling to obtain a hot-rolled steel sheet, and the hot-rolled steel sheet after subjection to the finish rolling is coiled.

(Heating)

Slab Heating Temperature: 1200° C. or Higher

In the heating, the steel stab is reheated to a slab heating temperature of 1200° C. or higher. When the slab heating temperature is less than 1200° C., the amount of solute N necessary to ensure the strength is decreased, leading to insufficient strength. Accordingly, the slab heating temperature is set to 1200° C. or higher.

In the steel composition in this disclosure, N in steel is considered to mainly exist as AlN. Therefore, (Ntotal−(N as AlN)) obtained by subtracting the amount of N existing as AlN (N as AlN) from the total amount of N (Ntotal) can be regarded as the amount of solute N. To achieve a yield strength of 560 MPa or more in a rolling direction, the amount of solute N is preferably 0.0071% or more, and such an amount of solute N can be obtained by setting the slab heating temperature to 1200° C. or higher. The amount of solute N is more preferably 0.0090% or more. This is achieved by setting the slab heating temperature to 1220° C. or higher. On the other hand, the slab heating temperature beyond 1300° C. fails to increase the effect, and thus, the slab heating temperature is preferably set to 1300° C. or lower.

(Finish Rolling)

Finisher Delivery Temperature: 870° C. or Higher

When the finisher delivery temperature of the hot rolling step is less than 870° C., ferrite of the steel sheet partially becomes fine, and the standard deviation of ferrite grain size becomes beyond 7.0 μm, deteriorating the formability. When such a steel sheet is used for crown caps, crown caps having non-uniform shapes would be formed. Accordingly, the finisher delivery temperature is set to 870° C. or higher. On the other hand, unnecessarily increasing the finisher delivery temperature may make it difficult to produce a thin steel sheet. Specifically, the finisher delivery temperature is preferably within a range of 870° C. or higher and 950° C. or lower.

Rolling Reduction at Final Stand: 10% or More

The rolling reduction at a final stand in the hot rolling step is set to 10% or more. When the rolling reduction at a final stand is less than 10%, ferrite of the steel sheet is partially coarsened and the standard deviation of ferrite grain size becomes beyond 7.0 μm, deteriorating the formability. As a result, when such a steel sheet is used for crown caps, crown caps having non-uniform shapes would be formed. Accordingly, the rolling reduction at a final stand is set to 10% or more. To more reduce the standard deviation of ferrite grain size, the rolling reduction at a final stand is preferably set to 12% or more. On the other hand, no upper limit is placed on the rolling reduction at a final stand, yet the rolling reduction is preferably set to 15% or less from the viewpoint of rolling load.

Coiling Temperature: 550° C. to 750° C.

When the coiling temperature in the hot rolling step is lower than 550° C., ferrite of the steel sheet partially becomes fine and the standard deviation of ferrite grain size becomes beyond 7.0 μm, deteriorating the formability. As a result, when such a steel sheet is used for crown caps, crown caps having non-uniform shapes would be formed. Accordingly, the coiling temperature is set to 550° C. or higher. On the other hand, when the coiling temperature is beyond 750° C., ferrite of the steel sheet is partially coarsened and the standard deviation of ferrite grain size becomes beyond 7.0 μm. From such a steel sheet, crown caps having non-uniform shapes would be formed. Accordingly, the coiling temperature is set to 750° C. or lower. The coiling temperature is preferably 600° C. or higher and 700° C. or lower.

[Pickling Step]

Next, the hot-rolled steel sheet after subjection to the hot rolling step is pickled. Oxide scales on a surface of the hot-rolled steel sheet can be removed by the pickling. Pickling conditions are not particularly limited and may be set as appropriate in accordance with a conventional method.

Next, the hot-rolled steel sheet after subjection to the pickling is subjected to cold rolling. The cold rolling is performed twice with continuous annealing therebetween.

[Primary Cold Rolling Step]

Rolling Reduction: 88% or More

First, the hot-rolled steel sheet after subjection to the pickling is subjected to primary cold rolling. The rolling reduction of the primary cold rolling step is set to 88% or more. When the rolling reduction of the primary cold rolling step is less than 88%, strain added to the steel sheet during the cold rolling is reduced. Thus, recrystallization in the continuous annealing step become non-uniform and the standard deviation of ferrite grain size becomes beyond 7.0 μm. As a result, the formability of the steel sheet is deteriorated, and when such a steel sheet is used for crown caps, crown caps having non-uniform shapes would be formed. Accordingly, the rolling reduction of the primary cold rolling is set to 88% or more. The rolling reduction is preferably set to 89% to 94%.

[Continuous Annealing Step]

Next, the primary cold-rolled sheet is subjected to continuous annealing. In the continuous annealing step, the steel sheet after subjection to the primary cold rolling step is heated to a soaking temperature and held in a temperature range of 660° C. to 760° C., and subsequently subjected to primary cooling and secondary cooling. Conditions at that time are as follows.

Soaking Temperature: 660° C. to 760° C.

The soaking temperature (annealing temperature) in the continuous annealing step beyond 760° C. easily causes a sheet passing failure such as heat buckling in the continuous annealing. Further, the ferrite grain size in the steel sheet is partially coarsened and the standard deviation of ferrite grain size becomes beyond 7.0 μm. From such a steel sheet, crown caps having non-uniform shapes would be formed. On the other hand, when the soaking temperature is less than 660° C., recrystallization becomes incomplete, and thus, the ferrite grain size of the steel sheet partially becomes fine. As a result, the standard deviation of ferrite grain size becomes beyond 7.0 μm, and from such a steel sheet, crown caps having non-uniform shapes would be formed. Accordingly, the soaking temperature is set to 660° C. to 760° C. The soaking temperature is preferably set to 680° C. to 730° C.

Average Heating Rate from 600° C. to Soaking Temperature: 15° C./s or Less

When the average heating rate from 600° C. to the soaking temperature is beyond 15° C./s, the yield strength difference (BH degree) in the rolling direction of the steel sheet is less than 25 MPa. As a result, when many crown caps for carbonated beverages having a high GV are produced from the steel sheet, some crown caps would be found to have a low pressure resistance and the yield in producing crown caps would be lowered. Accordingly, the average heating rate is set to 15° C./s or less. The average heating rate is preferably set to less than 10° C./s. On the other hand, an average heating rate less than 1° C./s not only fails to increase the effect but also incurs excessively high costs for heating equipment. Accordingly, the average heating rate is preferably set to 1° C./s or more and more preferably 2° C./s or more.

Holding Time: 60 Seconds or Less

The holding time (soaking time) for holding in a temperature range of 660° C. to 760° C. is set to 60 seconds or less. When the holding time is beyond 60 seconds, C contained in the steel sheet segregates to ferrite grain boundaries and precipitates as carbides in the cooling process after the soaking. As a result, the amount of solute C contributing to the steel sheet strength is decreased, lowering the yield strength. Accordingly, the holding time is set to 60 seconds or less. On the other hand, no lower limit is placed on the holding time, yet when a holding time is less than 5 seconds, the stability when the steel sheet is fed into rolls of a soaking zone may be deteriorated. Thus, the holding time is preferably set to 5 seconds or more.

Average Primary Cooling Rate: 10° C./s or More

After the soaking, the steel sheet is cooled to a temperature of 450° C. or lower (primary cooling stop temperature) at an average cooling rate of 10° C./s or more (primary cooling). An average cooling rate in the primary cooling (average primary cooling rate) of less than 10° C./s facilitates precipitation of carbides during the cooling to decrease the amount of solute C contributing to the steel sheet strength, lowering the yield strength. Accordingly, the average primary cooling rate is set to 10° C./s or more. On the other hand, an average primary cooling rate beyond 50° C./s fails to increase the effect, and thus the average primary cooling rate is preferably set to 50° C./s or less.

Primary Cooling Stop Temperature: 450° C. or Lower

A cooling stop temperature in the primary cooling (primary cooling stop temperature) beyond 450° C. facilitates precipitation of carbides after the primary cooling to decrease the amount of solute C contributing to the steel sheet strength, lowering the yield strength. Accordingly, the primary cooling stop temperature is set to 450° C. or lower. On the other hand, no lower limit is placed on the primary cooling stop temperature, yet a primary cooling stop temperature of lower than 300° C. not only fails to increase the carbide precipitation suppressing effect but also may deteriorate the shape of the steel sheet during sheet passing, causing a trouble. Accordingly, the primary cooling stop temperature is preferably set to 300° C. or higher.

Average Secondary Cooling Rate: 5° C./s or More

After the primary cooling, the steel sheet is cooled to a temperature of 140° C. or lower (secondary cooling stop temperature) at an average cooling rate of 5° C./s or more (secondary cooling). An average cooling rate in the secondary cooling (average secondary cooling rate) of less than 5° C./s decreases the amount of solute C contributing to the steel sheet strength, lowering the yield strength. Accordingly, the average secondary cooling rate is set to 5° C./s or more. On the other hand, an average secondary cooling rate beyond 30° C./s not only fails to increase the effect but also incurs excessively high costs for cooling equipment. Accordingly, the average secondary cooling rate is preferably set to 30° C./s or less and more preferably 25° C./s or less.

Secondary Cooling Stop Temperature: 140° C. or Lower

A cooling stop temperature in the secondary cooling (secondary cooling stop temperature) beyond 140° C. decreases the amount of solute C contributing to the steel sheet strength, lowering the yield strength. Accordingly, the secondary cooling stop temperature is set to 140° C. or lower. On the other hand, no lower limit is placed on the secondary cooling stop temperature, yet a secondary cooling stop temperature of lower than 100° C. not only fails to increase the effect but also incurs excessively high costs for cooling equipment. Accordingly, the secondary cooling stop temperature is preferably set to 100° C. or higher and more preferably 120° C. or higher.

[Secondary Cold Rolling Step]

Rolling Reduction: 10% to 40%

In this disclosure, the second cold rolling (secondary cold rolling) after the continuous annealing is performed to thereby achieve a high yield strength. At that time, when the rolling reduction in the secondary cold rolling is less than 10%, a sufficient yield strength cannot be obtained. On the other hand, a rolling reduction of the secondary cold rolling beyond 40% increases the anisotropy. When such a steel sheet is used for, for example, crown caps, the uniformity of crown caps formed from the steel sheet would be deteriorated. Accordingly, the rolling reduction of the secondary cold rolling is set to 10% or more and 40% or less. The rolling reduction is preferably set to more than 15% and 35% or less.

The cold-rolled steel sheet obtained as stated above can be subsequently optionally subjected to surface treatment (for example, one or both of chemical conversion treatment and coating or plating treatment) to obtain a surface-treated steel sheet. For the chemical conversion treatment, for example, electrolytic chromate treatment can be used. Further, the method for the coating or plating treatment is not particularly limited, but electroplating can be used. The coating or plating treatment uses, for example, tin coating or plating, chromium coating or plating, and nickel coating or plating. Further, a coat or film of a print coating, adhesive varnish, and the like can be arbitrarily formed on the cold-rolled steel sheet, or coated or plated steel sheet obtained as stated above. The thickness of the layer subjected to surface treatment such as coating or plating is sufficiently small with respect to the sheet thickness, and thus, the effect to mechanical properties of the steel sheet can be ignored.

[Crown Cap]

A crown cap according to one of the embodiments can be obtained by forming the steel sheet for crown cap. More specifically, the crown cap preferably comprises a metal portion made of the steel sheet for crown cap and a resin liner laminated on the inside of the metal portion. The metal portion includes a disk-shaped portion which covers a bottle mouth and a pleated portion disposed in the periphery thereof. Further, the resin liner is attached to the disk-shaped portion.

The crown cap can be produced by, for example, blanking the steel sheet for crown cap into a circular shape, forming the blank by press forming, and subsequently fusing a liner on the blank. The thermal fusion of the liner can be conducted by, for example, dripping melted resin to the disk-shaped portion on the side contacting with contents of the crown cap, pressing a mold having a shape of the liner to the resin to form a liner and simultaneously thermally fusing the liner to the steel sheet. It is also possible that the steel sheet for crown cap is blanked into a circular shape and formed by press forming, and subsequently, resin formed in advance into a shape allowing easy adhesion to a bottle mouth is attached, with an adhesive or the like, to the disk-shaped portion on the side contacting with contents of the crown cap.

As resin used for the resin liner, soft resin is used. Examples of such soft resin include polyvinyl chloride, polyolefin, and polystyrene.

The resin liner preferably has an ultra-low loaded hardness (HTL) of less than 0.70. A liner having an ultra-low loaded hardness of less than 0.70 is soft and thus has excellent adhesion to a bottle mouth. Therefore, a resin liner having an ultra-low loaded hardness of less than 0.70 can be used to thereby further improve the pressure resistance of a crown cap.

The ultra-low loaded hardness can be measured in accordance with the method described in "JIS Z2255" (2003). In the measurement, a test piece cut out from the crown cap with the resin liner being attached to the crown cap is used. The ultra-low loaded hardness can be calculated by conducting a loading-unloading test using a dynamic microhardness tester and using a test force P (mN) and an obtained maximum indentation depth D (μm) in the following formula (2). More specifically, the ultra-low loaded hardness can be measured by the method described in the EXAMPLES section.

$$HTL=3.858\times P/D^2 \quad (2)$$

A crown cap of this disclosure is produced from a steel sheet excellent in material homogeneity. Thus, when the crown cap is used as a crown cap of carbonated beverages having a high GV, the crown cap has an excellent pressure resistance even after sheet metal thinning. Further, crown caps obtained from a steel sheet for crown cap according to this disclosure have excellent uniformity in their outer diameters and heights, thus improving the yield in the crown cap producing procedures and reducing the amount of waste discharged during crown cap production.

EXAMPLES

Next, a more detailed description of this disclosure is given below based on Examples. The following Examples merely represent preferred examples, and this disclosure is not limited to these examples.

(Example 1)

First, to evaluate the effect of the chemical composition of a steel sheet, the following test was conducted.

Steels having the chemical compositions listed in Table 1 were each prepared by steelmaking in a converter and subjected to continuous casting to obtain steel slabs. The obtained steel slabs were subjected to treatments in the hot rolling step, the pickling step, the primary cold rolling step, the continuous annealing step, and the secondary cold rolling step in sequence under conditions listed in Table 2 to produce steel sheets, each having a sheet thickness listed in Table 3.

Subsequently, surfaces of the obtained steel sheets were continuously subjected to electrolytic chromate treatment to obtain tin-free steels as steel sheets for crown cap.

Next, the standard deviation of ferrite grain size, yield strength, yield strength difference, amount of solute N, and formability of each obtained steel sheet for crown cap were evaluated. The evaluation method for each item was as follows.

(Standard Deviation of Ferrite Grain Size)

Micrographs of each steel sheet for crown cap were taken using an optical microscope. From the obtained micrographs, the standard deviation of ferrite grain size in a region from a depth of ¼ of the sheet thickness to a mid-thickness part was determined. Specific procedures were as follows. First, a cross section of the steel sheet for crown cap taken in the sheet thickness direction parallel to the rolling direction of the steel sheet was polished and then etched with an etching solution (3 vol % nital). Next, 10 fields randomly selected from a region of from a depth position of ¼ of the sheet thickness (a position of ¼ in the thickness direction from the surface in the cross section) to a position of ½ of the sheet thickness in the cross section were observed at 400 times magnification under an optical microscope to obtain micrographs. The obtained micrographs were used to specify ferrite by visual observation and ferrite grain sizes were determined by image interpretation. Then, a ferrite grain size distribution was determined in each field to calculate its standard deviation. The average value of the standard deviations in the 10 fields was defined as a standard deviation of ferrite grain size. For the image interpretation, an image interpretation software "Stream Essentials" available from Olympus Corporation was used.

(Yield Strength)

The steel sheet for crown cap was subjected to heat treatment corresponding to paint baking (210° C., 15 minutes) and then a tensile test was conducted to measure the yield strength in the rolling direction of the steel sheet for crown cap. The tensile test was conducted using a tensile test piece with a size of JIS No. 5 in accordance with "JIS Z 2241". The heat treatment does not affect the chemical composition of the steel sheet for crown cap.

(Yield Strength Difference)

The yield strength difference in the rolling direction of the steel sheet for crown cap between a 2% strain tensile test and a tensile test after heat treatment was determined by a method in accordance with a test method for a degree of paint bake hardening (BH degree) defined in "JIS G3135". First, a tensile test piece with a size of JIS No. 5 was collected from the steel sheet for crown cap in a direction parallel to the rolling direction of the steel sheet. Next, using the test piece, a tensile test was conducted in accordance with "JIS G3135" to measure a 2% pre-strain load. Specifically, 2% pre-strain was added to the test piece and a load at that time (2% pre-strain load: P1) was read, and then the load was removed. Next, the test piece added with the pre-strain was subjected to heat treatment at 170° C. for 20 minutes, and after the heat treatment, a tensile test was conducted again to read the yield load (load after heat treatment: P2). P1, P2, and a cross-sectional area (A) of a parallel portion of the test piece before the pre-strain were used to calculate a BH degree (MPa) by the following formula (1). The obtained BH degree was defined as the yield strength difference between the 2% strain tensile test and the tensile test after heat treatment, in a rolling direction.

$$BH=(P2-P1)/A \quad (1)$$

(Amount of Solute N)

As stated above, in the steel composition according to this disclosure, N in steel is considered to exist as AlN. Therefore, (Ntotal−(N as AlN)) was obtained by subtracting the amount of N existing as AlN (N as AlN) from the total amount of N (Ntotal) and defined as the amount of solute N. The amount of N existing as AlN was determined by dissolving a sample in a 10% Br methanol solution and analyzing the residue.

(Formability)

The obtained steel sheet for crown cap was formed into a crown cap by the following procedures and the formability of the steel sheet for crown cap was evaluated. First, the steel sheet for crown cap subjected to heat treatment corresponding to paint baking (210° C., 15 minutes) was punched to create a circular blank having a diameter of 37 mm. The circular blank was subjected to press working to form a crown cap. From each steel sheet for crown cap, 20 crown caps (N=20) were formed. The height of each crown cap (distance from a top face to a skirt lower end of each crown cap) was measured using a micrometer to calculate the standard deviation of the heights of the caps of N=20. The value (mm) of the standard deviation was defined as an index of the formability. When the standard deviation is 0.09 mm or less, the crown cap shape is excellent, and when the standard deviation is beyond 0.09 mm, the crown cap shape is poor.

A resin liner was attached to the inside of the disk-shaped portion of each formed crown cap to form a crown cap having the resin liner. As the resin liners, soft liners made of various resins having an ultra-low loaded hardness of less than 0.70 were used. On each obtained crown cap, the pressure resistance and the ultra-low loaded hardness of the liner were evaluated by the following procedures.

(Pressure Resistance)

The crown cap was driven to a commercially available bottle and the internal pressure at which the crown cap was removed was measured using Secure Seal Tester available from Secure Pak. The internal pressure at which the crown cap was removed was defined as the pressure resistance. A pressure test was conducted on the 20 crown caps of each steel sheet for crown cap. When the number of crown caps having a pressure resistance of 180 psi (1.241 MPa) or more was 18 or more, the corresponding steel sheet was judged to have passed (good). When the number of crown caps having a pressure resistance of 180 psi (1.241 MPa) or more was less than 18, the corresponding steel sheet was judged to have failed (poor).

(Ultra-Low Loaded Hardness)

The ultra-low loaded hardness of the liner was measured in accordance with the method described in "JIS Z2255" (2003). In the measurement, a test piece cut out from a crown cap having a resin liner attached to the steel sheet of the crown cap was used. The steel sheet side of the test piece in a state of being leveled was adhered and fixed using epoxy resin and a dynamic microhardness tester (DUH-W201S, Shimadzu Corporation) was used to conduct a loading-unloading test and measure ultra-low loaded hardness.

The measurement conditions were a test force P of 0.500 mN, a loading rate of 0.142 mN/s, a holding time of 5 seconds, a temperature of 23±2° C., and a humidity of 50±5%. A triangular pyramid-shaped diamond indenter having a vertex angle of 115° was used. The ultra-low loaded hardness HTL was calculated from the following formula (2) using the test force P (mN) and an obtained maximum indentation depth D (μm). The measurement was conducted at 10 points and the arithmetic mean value was defined as the ultra-low loaded hardness of the liner.

$$HTL=3.858\times P/D^2 \quad (2)$$

(Overall Evaluation)

When the standard deviation of the heights of the crown caps of N=20 in the formability test was 0.09 mm or less and the evaluation result in the pressure resistance test was successful (good), the overall evaluation was judged as good. When only one of the conditions was satisfied or neither of the conditions were satisfied, the overall evaluation was judged as poor.

TABLE 1

| Steel sample | Chemical composition (in mass %)* | | | | | | | |
|---|---|---|---|---|---|---|---|---|
| No. | C | Si | Mn | P | S | Al | N | Remarks |
| 1 | 0.0076 | 0.02 | 0.19 | 0.015 | 0.009 | 0.027 | 0.0104 | Example |
| 2 | 0.0099 | 0.02 | 0.16 | 0.017 | 0.011 | 0.032 | 0.0106 | Example |
| 3 | 0.0062 | 0.01 | 0.14 | 0.013 | 0.015 | 0.034 | 0.0108 | Example |
| 4 | 0.0090 | 0.01 | 0.15 | 0.009 | 0.007 | 0.041 | 0.0098 | Example |
| 5 | 0.0066 | 0.01 | 0.20 | 0.018 | 0.012 | 0.036 | 0.0101 | Example |
| 6 | 0.0078 | 0.04 | 0.17 | 0.016 | 0.020 | 0.033 | 0.0125 | Example |
| 7 | 0.0071 | 0.02 | 0.59 | 0.012 | 0.014 | 0.030 | 0.0079 | Example |
| 8 | 0.0084 | 0.01 | 0.07 | 0.015 | 0.010 | 0.037 | 0.0132 | Example |
| 9 | 0.0073 | 0.02 | 0.49 | 0.009 | 0.013 | 0.039 | 0.0099 | Example |
| 10 | 0.0085 | 0.01 | 0.12 | 0.014 | 0.022 | 0.035 | 0.0123 | Example |
| 11 | 0.0064 | 0.02 | 0.18 | 0.032 | 0.016 | 0.044 | 0.0087 | Example |
| 12 | 0.0092 | 0.01 | 0.21 | 0.007 | 0.009 | 0.038 | 0.0105 | Example |
| 13 | 0.0069 | 0.02 | 0.19 | 0.011 | 0.048 | 0.031 | 0.0077 | Example |
| 14 | 0.0077 | 0.01 | 0.23 | 0.019 | 0.005 | 0.039 | 0.0115 | Example |
| 15 | 0.0088 | 0.02 | 0.36 | 0.012 | 0.014 | 0.048 | 0.0132 | Example |
| 16 | 0.0063 | 0.02 | 0.25 | 0.018 | 0.036 | 0.021 | 0.0081 | Example |
| 17 | 0.0081 | 0.01 | 0.28 | 0.014 | 0.011 | 0.044 | 0.0119 | Example |
| 18 | 0.0079 | 0.01 | 0.37 | 0.010 | 0.015 | 0.031 | 0.0093 | Example |
| 19 | 0.0066 | 0.01 | 0.18 | 0.023 | 0.009 | 0.038 | 0.0138 | Example |
| 20 | 0.0097 | 0.01 | 0.24 | 0.015 | 0.027 | 0.022 | 0.0071 | Example |
| 21 | 0.0082 | 0.02 | 0.35 | 0.020 | 0.014 | 0.039 | 0.0124 | Example |
| 22 | 0.0091 | 0.02 | 0.21 | 0.017 | 0.019 | 0.027 | 0.0086 | Example |
| 23 | 0.0108 | 0.01 | 0.16 | 0.013 | 0.022 | 0.033 | 0.0109 | Comparative Example |
| 24 | 0.0123 | 0.02 | 0.22 | 0.009 | 0.017 | 0.025 | 0.0103 | Comparative Example |
| 25 | 0.0161 | 0.01 | 0.14 | 0.021 | 0.023 | 0.042 | 0.0107 | Comparative Example |
| 26 | 0.0057 | 0.02 | 0.25 | 0.018 | 0.011 | 0.039 | 0.0104 | Comparative Example |
| 27 | 0.0042 | 0.01 | 0.21 | 0.015 | 0.016 | 0.043 | 0.0108 | Comparative Example |
| 28 | 0.0031 | 0.01 | 0.19 | 0.011 | 0.024 | 0.038 | 0.0100 | Comparative Example |
| 29 | 0.0083 | 0.02 | 0.82 | 0.016 | 0.015 | 0.041 | 0.0079 | Comparative Example |
| 30 | 0.0074 | 0.02 | 0.26 | 0.017 | 0.022 | 0.079 | 0.0133 | Comparative Example |
| 31 | 0.0069 | 0.02 | 0.23 | 0.012 | 0.019 | 0.005 | 0.0115 | Comparative Example |
| 32 | 0.0077 | 0.02 | 0.25 | 0.010 | 0.031 | 0.043 | 0.0196 | Comparative Example |
| 33 | 0.0086 | 0.01 | 0.24 | 0.014 | 0.009 | 0.036 | 0.0172 | Comparative Example |
| 34 | 0.0091 | 0.01 | 0.18 | 0.021 | 0.016 | 0.039 | 0.0148 | Comparative Example |
| 35 | 0.0085 | 0.02 | 0.21 | 0.016 | 0.022 | 0.027 | 0.0068 | Comparative Example |
| 36 | 0.0079 | 0.02 | 0.32 | 0.008 | 0.014 | 0.031 | 0.0055 | Comparative Example |
| 37 | 0.0088 | 0.02 | 0.27 | 0.020 | 0.018 | 0.029 | 0.0032 | Comparative Example |

TABLE 1-continued

| Steel sample | Chemical composition (in mass %)* | | | | | | | |
|---|---|---|---|---|---|---|---|---|
| No. | C | Si | Mn | P | S | Al | N | Remarks |
| 38 | 0.0093 | 0.01 | 0.19 | 0.065 | 0.015 | 0.042 | 0.0107 | Comparative Example |

*The balance is Fe and inevitable impurities.

Underlines mean that the corresponding values are outside the range of this disclosure.

TABLE 2

| | | Hot rolling step | | | | | Primary cold | Continuous annealing |
|---|---|---|---|---|---|---|---|---|
| Steel sheet No. | Steel sample No. | Slab heating temperature (° C.) | Finisher delivery temperature (° C.) | Rolling reduction at final stand (%) | Coiling temperature (° C.) | Hot-rolled sheet thickness (mm) | rolling step Rolling reduction (%) | step Average heating rate (° C./s) |
| 1 | 1 | 1250 | 880 | 10 | 625 | 2.8 | 93 | 13 |
| 2 | 2 | 1210 | 905 | 10 | 640 | 2.0 | 89 | 10 |
| 3 | 3 | 1240 | 875 | 11 | 615 | 2.7 | 93 | 12 |
| 4 | 4 | 1230 | 890 | 10 | 630 | 2.3 | 90 | 8 |
| 5 | 5 | 1260 | 910 | 11 | 645 | 2.6 | 92 | 14 |
| 6 | 6 | 1210 | 885 | 12 | 705 | 2.4 | 91 | 11 |
| 7 | 7 | 1250 | 875 | 11 | 690 | 2.4 | 89 | 9 |
| 8 | 8 | 1220 | 940 | 14 | 575 | 2.0 | 90 | 12 |
| 9 | 9 | 1240 | 910 | 12 | 605 | 2.5 | 91 | 6 |
| 10 | 10 | 1270 | 890 | 13 | 580 | 2.7 | 91 | 10 |
| 11 | 11 | 1210 | 895 | 10 | 595 | 2.4 | 89 | 5 |
| 12 | 12 | 1280 | 870 | 11 | 750 | 2.4 | 90 | 7 |
| 13 | 13 | 1230 | 900 | 12 | 735 | 2.3 | 90 | 11 |
| 14 | 14 | 1240 | 895 | 12 | 600 | 2.1 | 90 | 15 |
| 15 | 15 | 1220 | 920 | 11 | 635 | 2.0 | 89 | 13 |
| 16 | 16 | 1250 | 875 | 13 | 710 | 2.1 | 89 | 5 |
| 17 | 17 | 1260 | 950 | 11 | 695 | 2.5 | 91 | 2 |
| 18 | 18 | 1290 | 915 | 14 | 590 | 2.2 | 89 | 10 |
| 19 | 19 | 1210 | 900 | 12 | 550 | 2.0 | 91 | 12 |
| 20 | 20 | 1280 | 905 | 11 | 585 | 2.9 | 94 | 4 |
| 21 | 21 | 1250 | 890 | 10 | 655 | 2.3 | 90 | 8 |
| 22 | 22 | 1230 | 895 | 11 | 670 | 2.2 | 90 | 11 |
| 23 | 23 | 1290 | 870 | 11 | 715 | 2.1 | 90 | 13 |
| 24 | 24 | 1260 | 935 | 11 | 595 | 2.6 | 90 | 6 |
| 25 | 25 | 1220 | 890 | 10 | 680 | 2.0 | 90 | 9 |
| 26 | 26 | 1240 | 905 | 15 | 660 | 2.5 | 91 | 12 |
| 27 | 27 | 1250 | 875 | 13 | 600 | 2.7 | 91 | 4 |
| 28 | 28 | 1270 | 895 | 14 | 645 | 2.6 | 91 | 15 |
| 29 | 29 | 1250 | 900 | 11 | 720 | 2.1 | 90 | 11 |
| 30 | 30 | 1230 | 910 | 12 | 625 | 2.1 | 90 | 2 |
| 31 | 31 | 1240 | 925 | 11 | 750 | 2.1 | 90 | 10 |
| 32 | 32 | 1240 | 915 | 10 | 735 | 2.4 | 89 | 8 |
| 33 | 33 | 1260 | 875 | 12 | 665 | 2.1 | 91 | 5 |
| 34 | 34 | 1230 | 895 | 10 | 550 | 2.2 | 90 | 7 |
| 35 | 35 | 1260 | 950 | 13 | 565 | 2.6 | 90 | 14 |
| 36 | 36 | 1210 | 930 | 15 | 605 | 2.1 | 91 | 10 |
| 37 | 37 | 1230 | 890 | 10 | 705 | 2.5 | 91 | 9 |
| 38 | 38 | 1220 | 875 | 10 | 590 | 2.7 | 91 | 11 |

| | | Continuous annealing step | | | | | | Secondary cold rolling | |
|---|---|---|---|---|---|---|---|---|---|
| Steel sheet No. | Steel sample No. | Soaking temperature (° C.) | Holding time (s) | Average primary cooling rate (° C./s) | Primary cooling stop temperature (° C.) | Average secondary cooling rate (° C./s) | Secondary cooling stop temperature (° C.) | step Rolling reduction (%) | Remarks |
| 1 | 1 | 710 | 36 | 24 | 405 | 11 | 125 | 15.0 | Example |
| 2 | 2 | 685 | 25 | 30 | 390 | 9 | 120 | 25.0 | Example |
| 3 | 3 | 690 | 8 | 21 | 430 | 12 | 135 | 10.0 | Example |
| 4 | 4 | 705 | 14 | 17 | 420 | 15 | 130 | 30.0 | Example |
| 5 | 5 | 730 | 39 | 23 | 405 | 13 | 135 | 25.0 | Example |
| 6 | 6 | 675 | 42 | 19 | 415 | 6 | 140 | 20.0 | Example |
| 7 | 7 | 660 | 21 | 25 | 350 | 10 | 105 | 35.0 | Example |
| 8 | 8 | 725 | 30 | 48 | 395 | 24 | 130 | 15.0 | Example |
| 9 | 9 | 695 | 53 | 16 | 445 | 17 | 130 | 25.0 | Example |
| 10 | 10 | 715 | 9 | 11 | 435 | 19 | 125 | 30.0 | Example |

TABLE 2-continued

| | | | | | | | | | |
|---|---|---|---|---|---|---|---|---|---|
| 11 | 11 | 680 | 17 | 32 | 360 | 13 | 125 | 40.0 | Example |
| 12 | 12 | 720 | 26 | 20 | 375 | 9 | 100 | 35.0 | Example |
| 13 | 13 | 665 | 45 | 18 | 425 | 14 | 135 | 30.0 | Example |
| 14 | 14 | 750 | 38 | 13 | 435 | 28 | 120 | 20.0 | Example |
| 15 | 15 | 670 | 16 | 22 | 330 | 11 | 110 | 25.0 | Example |
| 16 | 16 | 700 | 29 | 14 | 355 | 18 | 135 | 25.0 | Example |
| 17 | 17 | 665 | 31 | 31 | 400 | 13 | 115 | 35.0 | Example |
| 18 | 18 | 690 | 27 | 17 | 365 | 21 | 120 | 30.0 | Example |
| 19 | 19 | 705 | 52 | 42 | 405 | 16 | 125 | 15.0 | Example |
| 20 | 20 | 710 | 18 | 29 | 380 | 12 | 135 | 10.0 | Example |
| 21 | 21 | 695 | 24 | 34 | 420 | 9 | 135 | 25.0 | Example |
| 22 | 22 | 685 | 33 | 27 | 345 | 11 | 130 | 25.0 | Example |
| 23 | 23 | 670 | 28 | 16 | 435 | 10 | 135 | 30.0 | Comparative Example |
| 24 | 24 | 690 | 12 | 31 | 450 | 22 | 100 | 35.0 | Comparative Example |
| 25 | 25 | 725 | 7 | 29 | 390 | 18 | 120 | 15.0 | Comparative Example |
| 26 | 26 | 705 | 54 | 43 | 335 | 15 | 140 | 20.0 | Comparative Example |
| 27 | 27 | 660 | 47 | 18 | 425 | 9 | 130 | 40.0 | Comparative Example |
| 28 | 28 | 695 | 22 | 33 | 395 | 16 | 135 | 35.0 | Comparative Example |
| 29 | 29 | 755 | 40 | 15 | 405 | 29 | 105 | 25.0 | Comparative Example |
| 30 | 30 | 705 | 19 | 19 | 400 | 14 | 125 | 25.0 | Comparative Example |
| 31 | 31 | 680 | 50 | 24 | 375 | 22 | 130 | 20.0 | Comparative Example |
| 32 | 32 | 675 | 23 | 32 | 415 | 6 | 100 | 35.0 | Comparative Example |
| 33 | 33 | 715 | 37 | 49 | 435 | 19 | 135 | 15.0 | Comparative Example |
| 34 | 34 | 730 | 41 | 10 | 410 | 13 | 125 | 25.0 | Comparative Example |
| 35 | 35 | 745 | 28 | 26 | 430 | 11 | 110 | 35.0 | Comparative Example |
| 36 | 36 | 700 | 42 | 16 | 440 | 10 | 135 | 10.0 | Comparative Example |
| 37 | 37 | 695 | 26 | 19 | 370 | 16 | 105 | 30.0 | Comparative Example |
| 38 | 38 | 680 | 35 | 22 | 385 | 17 | 125 | 30.0 | Comparative Example |

* Underlines mean that the corresponding values are outside the range of this disclosure.

TABLE 3

| Steel sheet No. | Steel sample No. | Sheet thickness (mm) | Standard deviation of ferrite grain size (μm) | Yield strength difference (MPa) | Yield strength in rolling direction (MPa) | Amount of solute N (%) | Ultra-low loaded hardness HTL | Formability (mm) | Pressure resistance | Overall evaluation | Remarks |
|---|---|---|---|---|---|---|---|---|---|---|---|
| 1 | 1 | 0.17 | 5.85 | 34 | 604 | 0.0093 | 0.53 | 0.05 | good | good | Example |
| 2 | 2 | 0.17 | 6.92 | 42 | 685 | 0.0091 | 0.46 | 0.05 | good | good | Example |
| 3 | 3 | 0.17 | 5.74 | 27 | 563 | 0.0089 | 0.38 | 0.07 | good | good | Example |
| 4 | 4 | 0.16 | 6.16 | 35 | 672 | 0.0092 | 0.49 | 0.06 | good | good | Example |
| 5 | 5 | 0.16 | 5.41 | 30 | 618 | 0.0094 | 0.51 | 0.06 | good | good | Example |
| 6 | 6 | 0.17 | 5.93 | 26 | 636 | 0.0105 | 0.62 | 0.05 | good | good | Example |
| 7 | 7 | 0.17 | 5.37 | 28 | 684 | 0.0073 | 0.23 | 0.06 | good | good | Example |
| 8 | 8 | 0.17 | 5.98 | 31 | 571 | 0.0126 | 0.41 | 0.04 | good | good | Example |
| 9 | 9 | 0.17 | 5.29 | 29 | 639 | 0.0092 | 0.63 | 0.06 | good | good | Example |
| 10 | 10 | 0.17 | 5.51 | 31 | 608 | 0.0117 | 0.68 | 0.06 | good | good | Example |
| 11 | 11 | 0.16 | 5.90 | 28 | 695 | 0.0081 | 0.37 | 0.07 | good | good | Example |
| 12 | 12 | 0.16 | 6.34 | 31 | 643 | 0.0094 | 0.28 | 0.06 | good | good | Example |
| 13 | 13 | 0.16 | 6.72 | 26 | 631 | 0.0075 | 0.15 | 0.06 | good | good | Example |
| 14 | 14 | 0.17 | 5.66 | 28 | 617 | 0.0108 | 0.33 | 0.04 | good | good | Example |
| 15 | 15 | 0.17 | 5.49 | 30 | 639 | 0.0126 | 0.37 | 0.06 | good | good | Example |
| 16 | 16 | 0.17 | 5.83 | 25 | 604 | 0.0079 | 0.64 | 0.07 | good | good | Example |
| 17 | 17 | 0.15 | 5.92 | 29 | 646 | 0.0107 | 0.21 | 0.05 | good | good | Example |
| 18 | 18 | 0.17 | 6.07 | 27 | 635 | 0.0085 | 0.45 | 0.04 | good | good | Example |

TABLE 3-continued

| Steel sheet No. | Steel sample No. | Sheet thickness (mm) | Standard deviation of ferrite grain size (μm) | Yield strength difference (MPa) | Yield strength in rolling direction (MPa) | Amount of solute N (%) | Ultra-low loaded hardness HTL | Formability (mm) | Pressure resistance | Overall evaluation | Remarks |
|---|---|---|---|---|---|---|---|---|---|---|---|
| 19 | 19 | 0.15 | 6.79 | 38 | 673 | 0.0136 | 0.36 | 0.08 | good | good | Example |
| 20 | 20 | 0.16 | 6.26 | 41 | 567 | 0.0071 | 0.42 | 0.07 | good | good | Example |
| 21 | 21 | 0.17 | 6.13 | 40 | 662 | 0.0121 | 0.39 | 0.04 | good | good | Example |
| 22 | 22 | 0.17 | 6.85 | 41 | 628 | 0.0083 | 0.32 | 0.05 | good | good | Example |
| 23 | 23 | 0.15 | 7.62 | 34 | 724 | 0.0095 | 0.24 | 0.15 | good | poor | Comparative Example |
| 24 | 24 | 0.17 | 7.24 | 32 | 731 | 0.0097 | 0.36 | 0.13 | good | poor | Comparative Example |
| 25 | 25 | 0.17 | 7.91 | 31 | 756 | 0.0099 | 0.50 | 0.17 | good | poor | Comparative Example |
| 26 | 26 | 0.18 | 7.45 | 17 | 515 | 0.0098 | 0.08 | 0.13 | poor | poor | Comparative Example |
| 27 | 27 | 0.15 | 7.63 | 14 | 537 | 0.0104 | 0.43 | 0.14 | poor | poor | Comparative Example |
| 28 | 28 | 0.15 | 7.37 | 16 | 522 | 0.0096 | 0.35 | 0.16 | poor | poor | Comparative Example |
| 29 | 29 | 0.16 | 7.42 | 29 | 738 | 0.0075 | 0.19 | 0.15 | good | poor | Comparative Example |
| 30 | 30 | 0.16 | 7.36 | 27 | 530 | 0.0061 | 0.22 | 0.13 | poor | poor | Comparative Example |
| 31 | 31 | 0.17 | 7.60 | 25 | 551 | 0.0092 | 0.61 | 0.17 | good | poor | Comparative Example |
| 32 | 32 | 0.17 | 7.49 | 33 | 743 | 0.0166 | 0.40 | 0.14 | good | poor | Comparative Example |
| 33 | 33 | 0.16 | 7.58 | 30 | 728 | 0.0163 | 0.38 | 0.15 | good | poor | Comparative Example |
| 34 | 34 | 0.17 | 7.35 | 34 | 732 | 0.0139 | 0.25 | 0.14 | good | poor | Comparative Example |
| 35 | 35 | 0.17 | 7.77 | 18 | 545 | 0.0038 | 0.59 | 0.18 | poor | poor | Comparative Example |
| 36 | 36 | 0.17 | 7.81 | 13 | 514 | 0.0046 | 0.17 | 0.16 | poor | poor | Comparative Example |
| 37 | 37 | 0.16 | 7.18 | 15 | 536 | 0.0027 | 0.42 | 0.17 | poor | poor | Comparative Example |
| 38 | 38 | 0.17 | 7.92 | 32 | 715 | 0.0089 | 0.39 | 0.14 | good | poor | Comparative Example |

* Underlines mean that the corresponding values are outside the range of this disclosure.

The evaluation results of each item are listed in Table 3. As seen from the results, the steel sheets of Nos. 1 to 22 satisfying the requirements of this disclosure, which had a yield strength of 560 MPa or more in their rolling directions and a standard deviation of crown cap height of 0.09 mm or less, had excellent crown cap formability. On the other hand, the steel sheets of Nos. 23 to 25 failing to satisfy the requirements of this disclosure had an excessively high C content, and thus had a standard deviation of ferrite grain size of more than 7.0 μm. As a result, the steel sheets of Nos. 23 to 25 had a standard deviation of crown cap height of more than 0.09 mm and had poor crown cap formability.

The steel sheets of Nos. 26 to 28 had an extremely low C content, and thus had a standard deviation of ferrite grain size of more than 7.0 μm. As a result, the steel sheets of Nos. 26 to 28 had a standard deviation of crown cap height of more than 0.09 mm and had poor crown cap formability. Further, the steel sheets of Nos. 26 to 28 had a yield strength difference of less than 25 MPa and had a poor pressure resistance.

The steel sheet of No. 29 had an excessively high Mn content, and thus had a standard deviation of ferrite grain size of more than 7.0 μm. As a result, the steel sheet of No. 29 had a standard deviation of crown cap height of more than 0.09 mm and had poor crown cap formability.

The steel sheet of No. 30 had an excessively high Al content, and thus had increased formation of AlN, decreasing the amount of N contributing as solute N to the steel sheet strength. As a result, the steel sheet of No. 30 had a decreased steel sheet strength and a poor pressure resistance.

In the steel sheet of No. 31, the Al content was excessively low and thus a sufficient effect as a deoxidizer was not produced, causing solidification defect and increasing steel-making costs. Further, because a suitable amount of AlN could not be obtained during the recrystallization of ferrite in the annealing, the standard deviation of ferrite grain size after the annealing was increased and the ferrite grain size of the steel sheet after subjection to the secondary cold rolling was coarsened, leading to a standard deviation of ferrite grain size of more than 7.0 μm. As a result, the steel sheet of No. 31 had a standard deviation of crown cap height of more than 0.09 mm and poor crown cap formability.

The steel sheets of Nos. 32 to 34 had an excessively high N content, and thus the ferrite grain size of the steel sheets after subjection to the secondary cold rolling became fine and a standard deviation of ferrite grain size was more than 7.0 μm. As a result, the steel sheets of Nos. 32 to 34 had a standard deviation of crown cap height of more than 0.09 mm and had poor crown cap formability.

The steel sheets of Nos. 35 to 37 had an excessively low N content, and thus the ferrite grain size of the steel sheets was coarsened, leading to a standard deviation of ferrite grain size of more than 7.0 μm. As a result, the steel sheets of Nos. 35 to 37 had a standard deviation of crown cap height of more than 0.09 mm and had poor crown cap formability. Further, the amount of N contributing as solute N to the steel sheet strength was decreased, and thus the steel sheet strength was lowered and additionally, a yield strength difference became less than 25 MPa, leading to a poor pressure resistance.

The steel sheet of No. 38 had an excessively high P content, and thus a standard deviation of ferrite grain size became more than 7.0 μm and a standard deviation of crown cap height became more than 0.09 mm, leading to poor crown cap formability.

(Example 2)

Next, to evaluate the effect of the production conditions, the following test was conducted.

Steels having chemical compositions of steel sample Nos. 5, 9, 18, 21, 28, 29, and 31 listed in Table 1 were prepared by steelmaking in a converter and subjected to continuous casting to obtain slabs. The obtained steel slabs were subjected to treatments in the hot rolling step, the pickling step, the primary cold rolling step, the continuous annealing step, and the secondary cold rolling step in sequence under conditions listed in Table 4 to produce steel sheets having a sheet thickness listed in Table 5.

Subsequently, the obtained steel sheets were continuously subjected to usual Cr coating or plating to obtain tin-free steels as steel sheets for crown cap.

Next, the standard deviation of ferrite grain size, yield strength, yield strength difference, amount of solute N, formability, pressure resistance, and ultra-low loaded hardness of a liner of each obtained steel sheet for crown cap were evaluated by the same method as in Example 1.

TABLE 4

| | | Hot rolling step | | | | | Primary cold | Continuously annealing step |
|---|---|---|---|---|---|---|---|---|
| Steel sheet No. | Steel sample No. | Slab heating temperature (° C.) | Finisher delivery temperature (° C.) | Rolling reduction at final stand (%) | Coiling temperature (° C.) | Hot-rolled sheet thickness (mm) | rolling step Rolling reduction (%) | Average heating rate (° C./s) |
| 39 | 5 | 1260 | 895 | 11 | 645 | 2.5 | 91 | 11 |
| 40 | 5 | 1150 | 910 | 11 | 605 | 2.0 | 90 | 9 |
| 41 | 5 | 1240 | 830 | 10 | 610 | 2.2 | 89 | 14 |
| 42 | 5 | 1210 | 905 | 12 | 630 | 2.5 | 93 | 12 |
| 43 | 5 | 1220 | 890 | 7 | 725 | 2.3 | 90 | 13 |
| 44 | 5 | 1250 | 875 | 11 | 600 | 2.9 | 92 | 8 |
| 45 | 5 | 1230 | 910 | 11 | 515 | 2.2 | 91 | 15 |
| 46 | 9 | 1250 | 885 | 12 | 560 | 2.6 | 90 | 10 |
| 47 | 9 | 1220 | 940 | 12 | 595 | 2.3 | 90 | 7 |
| 48 | 9 | 1210 | 920 | 15 | 630 | 2.2 | 88 | 12 |
| 49 | 9 | 1240 | 915 | 13 | 745 | 2.7 | 92 | 14 |
| 50 | 9 | 1290 | 895 | 10 | 615 | 2.0 | 86 | 11 |
| 51 | 9 | 1260 | 905 | 11 | 635 | 2.5 | 91 | 6 |
| 52 | 9 | 1210 | 890 | 12 | 705 | 2.6 | 90 | 17 |
| 53 | 9 | 1250 | 915 | 11 | 640 | 2.1 | 90 | 10 |
| 54 | 9 | 1270 | 940 | 13 | 715 | 2.3 | 92 | 11 |
| 55 | 18 | 1260 | 875 | 12 | 570 | 2.9 | 89 | 2 |
| 56 | 18 | 1210 | 895 | 14 | 760 | 2.0 | 89 | 13 |
| 57 | 18 | 1230 | 935 | 12 | 730 | 2.1 | 90 | 21 |
| 58 | 18 | 1250 | 910 | 10 | 575 | 2.7 | 91 | 4 |
| 59 | 18 | 1240 | 890 | 13 | 590 | 4.0 | 94 | 9 |
| 60 | 18 | 1230 | 885 | 12 | 565 | 2.9 | 92 | 11 |
| 61 | 18 | 1260 | 925 | 11 | 595 | 2.4 | 93 | 13 |
| 62 | 21 | 1220 | 880 | 12 | 630 | 2.3 | 89 | 8 |
| 63 | 21 | 1240 | 900 | 11 | 605 | 3.0 | 93 | 10 |
| 64 | 21 | 1270 | 885 | 8 | 580 | 2.7 | 91 | 12 |
| 65 | 21 | 1250 | 920 | 10 | 600 | 2.7 | 91 | 11 |
| 66 | 21 | 1210 | 935 | 12 | 720 | 2.0 | 90 | 26 |
| 67 | 21 | 1230 | 925 | 13 | 705 | 2.4 | 90 | 13 |
| 68 | 21 | 1260 | 905 | 13 | 555 | 2.0 | 89 | 11 |
| 69 | 21 | 1290 | 890 | 11 | 585 | 2.0 | 89 | 9 |
| 70 | 21 | 1240 | 935 | 12 | 630 | 2.0 | 88 | 12 |
| 71 | 28 | 1210 | 945 | 12 | 665 | 2.0 | 89 | 10 |
| 72 | 28 | 1230 | 900 | 11 | 655 | 2.8 | 91 | 34 |
| 73 | 29 | 1250 | 885 | 10 | 575 | 4.4 | 92 | 14 |
| 74 | 29 | 1270 | 895 | 10 | 640 | 2.3 | 90 | 19 |
| 75 | 31 | 1220 | 925 | 8 | 650 | 2.0 | 90 | 5 |
| 76 | 31 | 1240 | 940 | 11 | 620 | 2.1 | 91 | 12 |

| | | Continuously annealing step | | | | | | Secondary cold rolling | |
|---|---|---|---|---|---|---|---|---|---|
| Steel sheet No. | Steel sample No. | Soaking temperature (° C.) | Holding time (s) | Average primary cooling rate (° C./s) | Primary cooling stop temperature (° C.) | Average secondary cooling rate (° C./s) | Secondary cooling stop temperature (° C.) | step Rolling reduction (%) | Remarks |
| 39 | 5 | 695 | 25 | 13 | 385 | 14 | 135 | 25.0 | Example |
| 40 | 5 | 710 | 43 | 12 | 345 | 11 | 130 | 15.0 | Comparative Example |
| 41 | 5 | 680 | 37 | 17 | 360 | 7 | 130 | 30.0 | Comparative Example |

TABLE 4-continued

| | | | | | | | | | |
|---|---|---|---|---|---|---|---|---|---|
| 42 | 5 | 720 | 29 | 35 | 445 | 9 | 135 | 10.0 | Example |
| 43 | 5 | 705 | 16 | 11 | 420 | 12 | 135 | 30.0 | Comparative Example |
| 44 | 5 | 690 | 52 | 16 | 435 | 23 | 140 | 30.0 | Example |
| 45 | 5 | 715 | 38 | 24 | 400 | 10 | 140 | 15.0 | Comparative Example |
| 46 | 9 | 685 | 14 | 30 | 385 | 15 | 105 | 35.0 | Example |
| 47 | 9 | 700 | 54 | 19 | 405 | 26 | 120 | 25.0 | Example |
| 48 | 9 | 755 | 91 | 23 | 365 | 13 | 110 | 40.0 | Comparative Example |
| 49 | 9 | 725 | 20 | 4 | 410 | 16 | 130 | 30.0 | Comparative Example |
| 50 | 9 | 695 | 36 | 18 | 425 | 21 | 115 | 40.0 | Comparative Example |
| 51 | 9 | 665 | 28 | 25 | 390 | 24 | 120 | 25.0 | Example |
| 52 | 9 | 680 | 13 | 16 | 435 | 6 | 130 | 35.0 | Comparative Example |
| 53 | 9 | 670 | 8 | 30 | 375 | 18 | 105 | 20.0 | Example |
| 54 | 9 | 675 | 33 | 14 | 390 | 25 | 105 | 20.0 | Example |
| 55 | 18 | 725 | 45 | 10 | 420 | 19 | 100 | 50.0 | Comparative Example |
| 56 | 18 | 710 | 11 | 23 | 405 | 8 | 135 | 25.0 | Comparative Example |
| 57 | 18 | 690 | 19 | 37 | 355 | 17 | 140 | 20.0 | Comparative Example |
| 58 | 18 | 710 | 53 | 21 | 370 | 11 | 125 | 35.0 | Example |
| 59 | 18 | 570 | 38 | 16 | 395 | 26 | 125 | 35.0 | Comparative Example |
| 60 | 18 | 720 | 42 | 24 | 425 | 2 | 115 | 30.0 | Comparative Example |
| 61 | 18 | 700 | 6 | 39 | 430 | 9 | 135 | 5.0 | Comparative Example |
| 62 | 21 | 715 | 57 | 11 | 380 | 13 | 130 | 35.0 | Example |
| 63 | 21 | 670 | 23 | 42 | 360 | 24 | 135 | 20.0 | Example |
| 64 | 21 | 745 | 30 | 28 | 405 | 20 | 115 | 30.0 | Comparative Example |
| 65 | 21 | 730 | 44 | 13 | 400 | 7 | 120 | 30.0 | Example |
| 66 | 21 | 715 | 39 | 19 | 415 | 14 | 105 | 15.0 | Comparative Example |
| 67 | 21 | 670 | 15 | 34 | 625 | 28 | 125 | 30.0 | Comparative Example |
| 68 | 21 | 685 | 28 | 28 | 390 | 15 | 130 | 25.0 | Example |
| 69 | 21 | 675 | 21 | 22 | 435 | 21 | 130 | 25.0 | Example |
| 70 | 21 | 725 | 36 | 16 | 385 | 16 | 190 | 35.0 | Comparative Example |
| 71 | 28 | 735 | 49 | 18 | 415 | 3 | 125 | 30.0 | Comparative Example |
| 72 | 28 | 680 | 22 | 15 | 365 | 17 | 135 | 35.0 | Comparative Example |
| 73 | 29 | 690 | 53 | 27 | 420 | 26 | 110 | 55.0 | Comparative Example |
| 74 | 29 | 705 | 47 | 41 | 370 | 2 | 110 | 30.0 | Comparative Example |
| 75 | 31 | 750 | 34 | 35 | 430 | 4 | 140 | 15.0 | Comparative Example |
| 76 | 31 | 685 | 17 | 20 | 435 | 18 | 150 | 10.0 | Comparative Example |

* Underlines mean that the corresponding values are outside the range of this disclosure.

TABLE 5

| Steel sheet No. | Steel sample No. | Sheet thickness (mm) | Standard deviation of ferrite grain size (μm) | Yield strength difference (MPa) | Yield strength in rolling direction (MPa) | Amount of solute N (%) | Ultra-low loaded hardness HTL | Formability (mm) | Pressure resistance | Overall evaluation | Remarks |
|---|---|---|---|---|---|---|---|---|---|---|---|
| 39 | 5 | 0.17 | 5.51 | 29 | 640 | 0.0095 | 0.58 | 0.06 | good | good | Example |
| 40 | 5 | 0.17 | 6.87 | 26 | 521 | 0.0062 | 0.31 | 0.05 | poor | poor | Comparative Example |
| 41 | 5 | 0.17 | 7.64 | 27 | 573 | 0.0091 | 0.44 | 0.16 | good | poor | Comparative Example |
| 42 | 5 | 0.16 | 5.23 | 30 | 594 | 0.0096 | 0.62 | 0.05 | good | good | Example |
| 43 | 5 | 0.16 | 7.78 | 28 | 639 | 0.0094 | 0.59 | 0.16 | good | poor | Comparative Example |

TABLE 5-continued

| Steel sheet No. | Steel sample No. | Sheet thickness (mm) | Standard deviation of ferrite grain size (μm) | Yield strength difference (MPa) | Yield strength in rolling direction (MPa) | Amount of solute N (%) | Ultra-low loaded hardness HTL | Formability (mm) | Pressure resistance | Overall evaluation | Remarks |
|---|---|---|---|---|---|---|---|---|---|---|---|
| 44 | 5 | 0.16 | 5.77 | 31 | 645 | 0.0098 | 0.41 | 0.06 | good | good | Example |
| 45 | 5 | 0.17 | 7.72 | 29 | 632 | 0.0097 | 0.55 | 0.17 | good | poor | Comparative Example |
| 46 | 9 | 0.17 | 5.33 | 30 | 651 | 0.0089 | 0.57 | 0.05 | good | good | Example |
| 47 | 9 | 0.17 | 5.60 | 31 | 638 | 0.0094 | 0.49 | 0.04 | good | good | Example |
| 48 | 9 | 0.16 | 6.56 | 28 | 543 | 0.0088 | 0.26 | 0.06 | poor | poor | Comparative Example |
| 49 | 9 | 0.15 | 6.35 | 29 | 536 | 0.0091 | 0.43 | 0.05 | poor | poor | Comparative Example |
| 50 | 9 | 0.17 | 7.59 | 28 | 594 | 0.0093 | 0.09 | 0.18 | good | poor | Comparative Example |
| 51 | 9 | 0.17 | 5.37 | 31 | 575 | 0.0090 | 0.32 | 0.04 | good | good | Example |
| 52 | 9 | 0.17 | 5.54 | 16 | 577 | 0.0087 | 0.06 | 0.06 | poor | poor | Comparative Example |
| 53 | 9 | 0.17 | 5.82 | 29 | 592 | 0.0091 | 0.64 | 0.06 | good | good | Example |
| 54 | 9 | 0.15 | 5.43 | 29 | 589 | 0.0093 | 0.38 | 0.06 | good | good | Example |
| 55 | 18 | 0.16 | 6.49 | 28 | 723 | 0.0077 | 0.53 | 0.17 | good | poor | Comparative Example |
| 56 | 18 | 0.17 | 7.27 | 31 | 571 | 0.0085 | 0.60 | 0.19 | good | poor | Comparative Example |
| 57 | 18 | 0.17 | 5.90 | 14 | 584 | 0.0079 | 0.25 | 0.08 | poor | poor | Comparative Example |
| 58 | 18 | 0.16 | 5.66 | 35 | 604 | 0.0086 | 0.61 | 0.06 | good | good | Example |
| 59 | 18 | 0.16 | 7.28 | 31 | 586 | 0.0088 | 0.47 | 0.18 | good | poor | Comparative Example |
| 60 | 18 | 0.16 | 5.91 | 30 | 533 | 0.0087 | 0.23 | 0.07 | poor | poor | Comparative Example |
| 61 | 18 | 0.16 | 5.76 | 32 | 519 | 0.0091 | 0.63 | 0.07 | poor | poor | Comparative Example |
| 62 | 21 | 0.16 | 5.67 | 35 | 647 | 0.0119 | 0.34 | 0.06 | good | good | Example |
| 63 | 21 | 0.17 | 5.74 | 39 | 635 | 0.0121 | 0.36 | 0.06 | good | good | Example |
| 64 | 21 | 0.17 | 7.23 | 32 | 632 | 0.0117 | 0.50 | 0.19 | good | poor | Comparative Example |
| 65 | 21 | 0.17 | 5.68 | 36 | 656 | 0.0119 | 0.67 | 0.07 | good | good | Example |
| 66 | 21 | 0.17 | 7.19 | 17 | 564 | 0.0106 | 0.63 | 0.07 | poor | poor | Comparative Example |
| 67 | 21 | 0.17 | 6.52 | 31 | 541 | 0.0108 | 0.48 | 0.07 | poor | poor | Comparative Example |
| 68 | 21 | 0.17 | 5.55 | 36 | 658 | 0.0121 | 0.39 | 0.06 | good | good | Example |
| 69 | 21 | 0.17 | 5.76 | 35 | 647 | 0.0119 | 0.69 | 0.05 | good | good | Example |
| 70 | 21 | 0.16 | 5.83 | 33 | 532 | 0.0104 | 0.42 | 0.07 | poor | poor | Comparative Example |
| 71 | 28 | 0.15 | 7.49 | 13 | 529 | 0.0085 | 0.33 | 0.18 | poor | poor | Comparative Example |
| 72 | 28 | 0.16 | 7.64 | 12 | 533 | 0.0078 | 0.11 | 0.16 | poor | poor | Comparative Example |
| 73 | 29 | 0.16 | 7.57 | 27 | 724 | 0.0074 | 0.62 | 0.17 | poor | poor | Comparative Example |
| 74 | 29 | 0.16 | 7.48 | 15 | 556 | 0.0072 | 0.37 | 0.15 | poor | poor | Comparative Example |
| 75 | 31 | 0.17 | 7.62 | 29 | 537 | 0.0106 | 0.49 | 0.17 | poor | poor | Comparative Example |
| 76 | 31 | 0.17 | 7.56 | 28 | 519 | 0.0103 | 0.22 | 0.18 | poor | poor | Comparative Example |

* Underlines mean that the corresponding values are outside the range of this disclosure.

The evaluation results of each item are listed in Table 5. As seen from the results, the steel sheets of No. 39, 42, 44, 46, 47, 51 to 54, 57, 58, 62, 63, 65, 68, and 69 satisfying the requirements of this disclosure, which had a yield strength of 560 MPa or more in their rolling directions and a standard deviation of crown cap height of 0.09 mm or less, had good crown cap formability and a good pressure resistance. On the other hand, comparative examples, steel sheets of Nos. 40, 48, 49, 60, 61, 67, and 70 had at least one of a slab heating temperature, a soaking duration, an average primary cooling rate, a secondary cold rolling reduction, an average secondary cooling rate, a primary cooling stop temperature, or a secondary cooling stop temperature outside the ranges according to this disclosure. Thus, the steel sheets of Nos. 40, 48, 49, 60, 61, 67, and 70 had a lowered yield strength in their rolling directions.

A comparative example, steel sheet of No. 55 had an excessively high secondary cold rolling reduction, and thus had increased anisotropy, a standard deviation of crown cap height of more than 0.09 mm, and poor crown cap formability.

Comparative examples, steel sheets of Nos. 52, 57, and 66 had an excessively high average heating rate, and thus, had a yield strength difference of less than 25 MPa and a poor pressure resistance.

Comparative examples, steel sheets of Nos. 71 to 76 had a chemical composition outside the range according to this disclosure and any of an average secondary cooling rate, a secondary cooling stop temperature, and a secondary cooling reduction outside the ranges according to this disclosure. Thus, the yield strength of the steel sheets in their rolling directions was lowered, and additionally a standard deviation of ferrite grain size became more than 7.0 μm and a standard deviation of crown cap height became more than 0.09 mm, leading to poor crown cap foamability.

The invention claimed is:

1. A steel sheet for crown cap having a chemical composition containing, in mass %, C: more than 0.0060% and 0.0100% or less, Si: 0.05% or less, Mn: 0.05% or more and 0.60% or less, P: 0.050% or less, S: 0.050% or less, Al: 0.020% or more and 0.050% or less, and N: 0.0070% or more and 0.0140% or less, with the balance being Fe and inevitable impurities, wherein the steel sheet has a ferrite phase in a region from a depth of ¼ of a sheet thickness to a mid-thickness part, the ferrite phase having a standard deviation of ferrite grain size of 7.0 μm or less, the steel sheet has a yield strength of 560 MPa or more and 700 MPa or less in a rolling direction, and the steel sheet has a difference of 25 MPa or more between a yield strength in a 2% strain tensile test and a yield strength in a tensile test after heat treatment at 170° C. for 20 minutes, in the rolling direction.

2. The steel sheet for crown cap according to claim 1 having a sheet thickness of 0.20 mm or less.

3. A crown cap made of the steel sheet for crown cap according to claim 1.

4. The crown cap according to claim 3 comprising a resin liner having an ultra-low loaded hardness of less than 0.70.

5. A method for producing the steel sheet for crown cap according to claim 1 comprising:

hot rolling a steel slab having the chemical composition according to claim 1, whereby the steel slab is heated to a slab heating temperature of 1200° C. or higher, and then the steel slab is subjected to hot rolling under conditions of a finisher delivery temperature of 870° C. or higher and a rolling reduction at a final stand of 10% or more to obtain a steel sheet, and then the steel sheet is coiled at a coiling temperature of 550° C. to 750° C.;

after the hot rolling, pickling the steel sheet;

after the pickling, subjecting the steel sheet to primary cold rolling at a rolling reduction of 88% or more;

after the primary cold rolling, subjecting the steel sheet to continuous annealing; and after the continuous annealing, subjecting the steel sheet to secondary cold rolling at a rolling reduction of 10% to 40%, wherein in the continuous annealing, the steel sheet is heated to a soaking temperature of 660° C. to 760° C. at an average heating rate of 15° C./s or less in a temperature range from 600° C. to the soaking temperature, the steel sheet is then held in a temperature range of 660° C. to 760° C. for a holding time of 60 seconds or less, after the holding, the steel sheet is subjected to primary cooling to a temperature of 450° C. or lower at an average cooling rate of 10° C./s or more, and subsequently, the steel sheet is subjected to secondary cooling to a temperature of 140° C. or lower at an average cooling rate of 5° C./s or more.

6. A crown cap made of the steel sheet for crown cap according to claim 2.

7. A method for producing the steel sheet for crown cap according to claim 2 comprising:

hot rolling a steel slab having the chemical composition according to claim 1, whereby the steel slab is heated to a slab heating temperature of 1200° C. or higher, and then the steel slab is subjected to hot rolling under conditions of a finisher delivery temperature of 870° C. or higher and a rolling reduction at a final stand of 10% or more to obtain a steel sheet, and then the steel sheet is coiled at a coiling temperature of 550° C. to 750° C.;

after the hot rolling, pickling the steel sheet;

after the pickling, subjecting the steel sheet to primary cold rolling at a rolling reduction of 88% or more;

after the primary cold rolling, subjecting the steel sheet to continuous annealing; and after the continuous annealing, subjecting the steel sheet to secondary cold rolling at a rolling reduction of 10% to 40%, wherein in the continuous annealing, the steel sheet is heated to a soaking temperature of 660° C. to 760° C. at an average heating rate of 15° C./s or less in a temperature range from 600° C. to the soaking temperature, the steel sheet is then held in a temperature range of 660° C. to 760° C. for a holding time of 60 seconds or less, after the holding, the steel sheet is subjected to primary cooling to a temperature of 450° C. or lower at an average cooling rate of 10° C./s or more, and subsequently, the steel sheet is subjected to secondary cooling to a temperature of 140° C. or lower at an average cooling rate of 5° C./s or more.

* * * * *